United States Patent [19]

Thon

[11] 4,131,291

[45] Dec. 26, 1978

[54] TILTABLE AND REMOVABLE SKI ATTACHMENT

[75] Inventor: Dieter Thon, Münich, Fed. Rep. of Germany

[73] Assignee: Safety Jet Skisicherheitsbugel GmbH, Münich, Fed. Rep. of Germany

[21] Appl. No.: 748,613

[22] Filed: Dec. 8, 1976

[30] Foreign Application Priority Data

Dec. 10, 1975 [DE] Fed. Rep. of Germany ..... 2555514

[51] Int. Cl.[2] ..... A63C 11/00

[52] U.S. Cl. ..... 280/11.37 E

[58] Field of Search ..... 280/11.37 E, 601

[56] References Cited

U.S. PATENT DOCUMENTS

| | | | |
|---|---|---|---|
| 3,863,943 | 2/1975 | Giannotti | 280/11.37 E |
| 3,951,421 | 4/1976 | Brangenberg | 280/11.37 E |
| 3,953,043 | 4/1976 | Hinterholzer | 280/11.37E |

FOREIGN PATENT DOCUMENTS

| | | | |
|---|---|---|---|
| 2418816 | 10/1975 | Fed. Rep. of Germany | 280/11.37 E |
| 2430570 | 1/1976 | Fed. Rep. of Germany | 280/11.37 E |

*Primary Examiner*—David M. Mitchell

*Attorney, Agent, or Firm*—William Anthony Drucker

[57] ABSTRACT

An attachment for skis, for preventing crossing of skis, includes a base plate for mounting on a ski, and a deflector which is releasably mounted on the base plate and which is pivotable thereon, under resilient biasing, from a lowered position substantially flat with respect to the base plate to a raised position upstanding on the base plate. The deflector is engaged releasably with the base plate by an axle passed transversely through the deflector and projecting therefrom at each end. The projecting ends of the axle each having a parallel sided portion of reduced width which, with the deflector lowered, can be passed into a keyhole aperture in a side wall of the base plate, whereas when the deflector is raised, the axle is retained in the aperture of the side wall. Releasable spring loading acts between the base plate and the deflector.

9 Claims, 6 Drawing Figures

TILTABLE AND REMOVABLE SKI ATTACHMENT

This invention relates to a tiltable and removable ski attachment which is connectable with the ski surface preferably by cementing.

Ski attachments are fastened to skis to prevent them from crossing over one another while skiing, thereby causing ski accidents which are frequently dangerous.

Initially, such ski attachments were designed and manufactured with a rigid, non-tiltable construction. Recently, however, a tiltable ski attachment has appeared on the market which is supposed to fulfill the task of a hitherto common, rigid ski attachment which prevents the skis from crossing, while also ensuring that, due to its tiltable construction, a ski, which has in fact become crossed over the other and over the ski attachment, can be returned to its normal position without being obstructed by said ski attachment.

Such a tiltable ski attachment has a deflection surface positioned substantially vertically on the ski which prevents the other ski from crossing over the first by remaining in this position rigidly or with a slight spring action if there is an impact on said deflection surface. However, if the one ski does actually cross the other over the ski deflector, the return of the crossed ski is to be facilitated by tipping the deflection surface in the direction in which the crossed ski is returned to its normal position. After the crossed ski has been returned to its normal position, the deflection surface automatically reassumes its vertical deflecting position.

In the case of the known tiltable ski attachment which prevents the skis from crossing the structural part with the deflection surface is maintained in its rigid deflecting position and is prevented from tilting in the direction of crossing by an opposing surface which is disposed practically parallel to the deflection surface and thus substantially perpendicular to the ski. The tiltability of the attachment in the direction of return of the crossed ski is achieved by means of a mechanism whose design is relatively expensive. One drawback of such tiltable ski attachments is on the one hand the circumstance that a surface substantially parallel to the deflection surface must be secured to the ski attachment as an opposing surface to prevent the deflection surface from tilting in the direction of ski crossing. Moreover, other drawbacks result from the complexity of the return design of the deflection part into the deflecting position. Finally, the ski attachment cannot be removed from the ski.

The object of the instant invention is thus to obviate these drawbacks by means of a design in which in particular the effect of a force caused by the impact of the ski on the substantially vertical deflection surface of the deflection part is not transmitted against a substantially parallel opposing surface designed for this purpose, but rather to the base surface parallel to the skis. Furthermore, the deflection part can be removed from said base plate which remains on the ski. This simplifies considerably the design of the inventive ski attachment on the one hand, resulting in particular in advantages with respect to the susceptability to damage and the servicing of the inventive ski attachment. On the other hand, servicing and, if necessary, repair work are simplified considerably due to the removability of the deflection part as well. If damage occurs to the tiltable ski deflector now on the market, the entire ski must be sent to be repaired, completely irrespective of the location of the damage. If irreparable damage occurs in the deflection part (breakage) or in the mechanism, the entire ski attachment must be broken off the skis. This is all the more difficult and sometimes results in damage to the skis since the adhesive connection between the ski attachment and the ski must be very firm due to the strong impacts which the ski attachment may have to absorb. In the case of the ski attachment in accordance with the invention, the entire mechanism is located on or in the deflection part which is designed to be removable. For this reasons, damage occurs substantially to the deflection part, if at all. In the case of irreparable damage, the mechanism or the entire deflection part can be exchanged without any difficulty.

Finally, after the deflection part of the ski attachment in accordance with the invention has been removed from the base plate, it can be turned 180° about its vertical axis and reinserted into the axle bearing located on the base plate. The deflection part can now be tilted onto the base plate on the skis and engaged with the base plate by means of a snap so that, if the deflection part is not supposed to be removed entirely from the base plate for example during transportation of the skis, it can remain on the skis in this transportation position without being in the way.

The ski attachment in accordance with the invention is particularly advantageous if the base plate has an adhesive in the form of a thin coating on the underside for rapid and simple attachment thereto. This coat is protected by a stripping foil until the base plate is secured to the skis. In particular, the adhesive can be applied in the form of a coating which has as the carrier material an open-pored foam rubber strip impregnated with an adhesive solution or emulsion. This strip can advantageously consist of polyurethane and in particular is especially effective if its thickness amounts to less than 0.8 mm.

The present invention will now be explained in detail in the following with reference to the figures, of the accompanying drawings.

Figure 1:
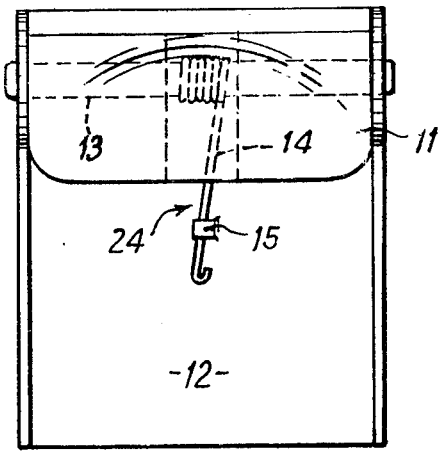
FIG. 1 is a plan view of the ski attachment.
Figure 2:
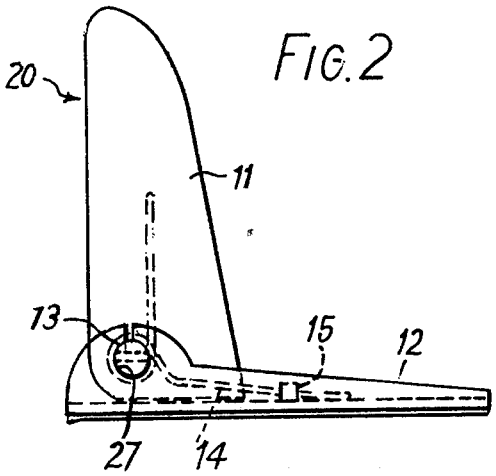
FIG. 2 is a side elevation thereof.
Figure 3:
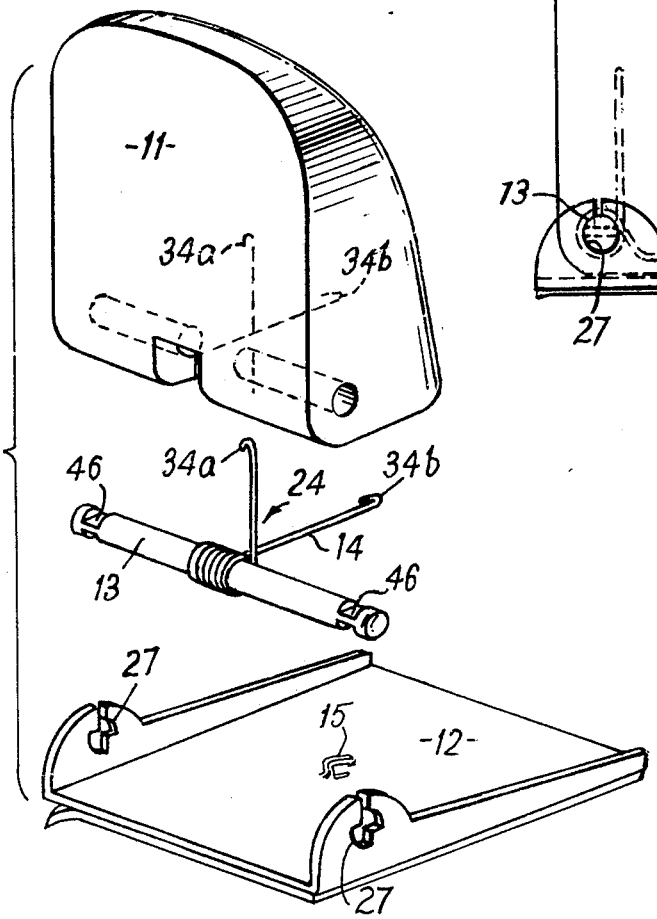
FIG. 3 is a perspective view, with the parts shown in separated condition.

In FIGS. 1 to 3, number 11 designates the deflection part, 12 the base plate to be cemented to the ski, 13 the axle about which the deflection part 11 is rotatable, 14 the spiral-shaped spring wire which is wound about the axle 13, and 15 the hook-shaped spring catch located on said base plate.

Reference numeral 20 indicates the deflection surface of the deflection part 11 which prevents the other ski from crossing the first. The axle 13 is located in an axle bearing 27 in the upright side edge of the base plate 12. The end 24 of the spring is hooked in the hook-shaped catch 15 on the base plate.

The spring wire 14 is wound in a spiral fashion about the axle 13, one end **34*a* being anchored in said deflection part 11 and the other end 34*b* being conducted through a hole in the axle 13 into engagement with the hook-shaped catch 15. The area 46 of the axle 13 is milled from opposite sides such that the bridge remaining in the middle of said axle has a cross section which is practically rectangular. The thickness of said substantially rectangular bridge corresponds to the slot in the axle bearing 27. This area of the axle is inserted into said slot, using the narrow side of said bridge, the axle being locked in this position by rotating it 90° in the axle bearing 27**.

Correspondingly, the axle bearing 27 situated in the upright side edges of the base plate 12 is designed such that the axle area 46 can be inserted into the slot and can be locked therein by rotating it through 90°.

Figure 4:
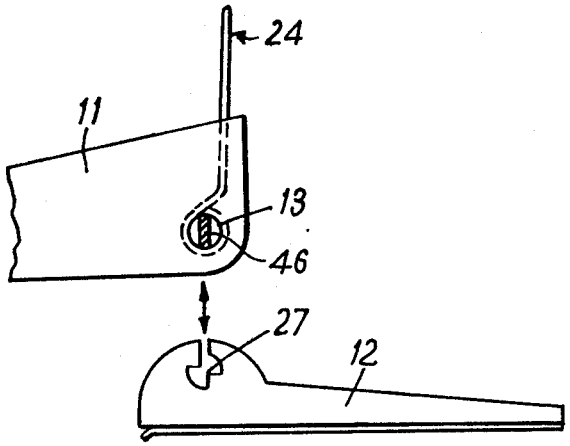
FIG. 4 is a partial side elevation showing an intermediate stage in assembly of the parts of the attachment.
Figure 5:
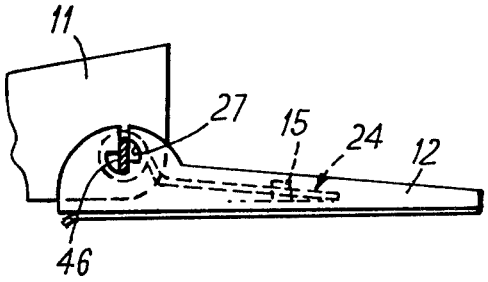
FIG. 5 is a partial side elevation showing another intermediate step in assembly or dissembly of the parts of the attachment.

The co-operation of the axle and the axle bearing is clarified in FIGS. 4 and 5. The axle 13, which has an almost rectangular cross section at 46, is disposed in the deflection part 11 such that the longitudinal side of the rectangle extends practically parallel to the base surface of the deflection part 11. This base surface overlies the base plate 12 when the deflection part is in its deflecting position. When the axle and the deflection part are located in this position, the axle section 46 can be inserted into the correspondingly designed axle bearing 27 through the slot. By rotating the deflection part 11 90° in an upward direction, the rectangular portion of the axle is rotated in the axle bearing such that it is locked in said bearing and cannot be removed from the axle bearing by an upward pull. The end of the spring 14 is then engaged with the spring catch on the base plate.

In FIG. 5, the end of the spring wire 14 is located in the spring catch 15 on the base plate 12 and is under tension due to the tilting of the deflection part 11. If the deflection part 11 is released, it automatically returns to the vertical deflecting position due to the tension of the spring. In so doing, however, the axle does not rotate in the axle bearing, but is maintained in the locked position by the engaged spring wire 14 as well. The deflection part itself rotates about the axle.

The device in accordance with the invention is especially advantageous if the base plate or its upright lateral edges are designed to increase in height towards the tilted deflection part so that a steady, uninterrupted return of the crossed ski is guaranteed.

Figure 6:
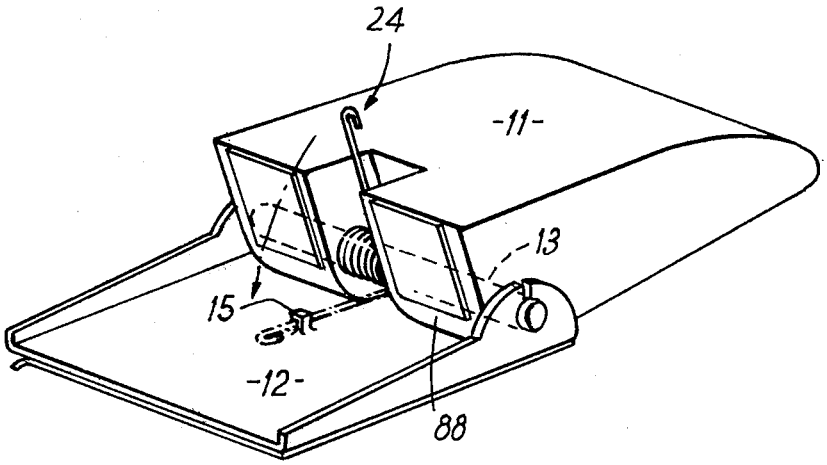
FIG. 6 is a perspective view showing an intermediate stage of assembly.

In FIG. 6 the deflection part 11 is being inserted into the axle bearing. By rotating the deflection part 11 into its vertical deflecting position, the axle is locked in the axle bearing on the one hand, while on the other hand the spring end 14 approaches the base plate 12 and can be hooked into the spring catch 15, thereby rendering the inventive ski attachment functionable.

In order to absorb an impact against the deflection part the underside 88 of the deflection part 11 can be provided with an absorptive layer of plastic foam, foam rubber or neoprene.

If the deflection part 11 is inserted into the axle bearing after having been rotated about 180° around its vertical axis, it can be tilted such that the side of the deflection part provided to absorb the impact lies on the base plate 12. By correspondingly designing the spring catch 15 and a corresponding recess, for example, on the deflecting side of said deflection part, the base plate 12 and the deflection part 11 can be interconnected in a snap fashion. This position is advantageous for transporting the skis.

The arrangement of the ski attachment in accordance with the invention as depicted in the drawings has been simplified substantially in a schematic manner for the sake of clarity. No sharp edges or projections are permitted for safety reasons in the practical design of the ski attachment. It is also advantageous in particular to produce the base plate, in addition to said deflection part, of tough, impact-resistant plastic. In particular, fiberglass-reinforced plastics, polypropylene with or without fiberglass or polyamides or similar homo- or copolymers are suitable for this purpose.

What is claimed is:

1. An anti-crossing attachment for skis comprising:

(i) a base plate having a base portion, for attachment to a ski, and spaced opposed upstanding side wall portions on said base portion, each side wall portion having therein an aperture including a slot one end of which opens at the upper edge of the side wall portion and the other end of which terminates in an opening of greater width than the slot, (ii) a deflector having an upper end and a lower end and with an axle engaged transversely through the lower end and projecting at each of its ends from the deflector, said axle being locked against rotation with respect to the deflector, said axle having in each of its projecting ends a portion of reduced diametral thickness which is dimensioned to permit it to be passed, when the axle is in a first position of rotation, through the slot into the opening, but to be incapable of passing outwardly from the opening through the slot when the axle is in a second position of rotation 90° removed from said first position, said first position corresponding to the deflector being in a lowered condition with respect to the base plate and said second position corresponding to the deflector being in a raised condition with respect to the base plate, (iii) disengageable resilient means to act between the base plate and the deflector to urge the deflector to raised condition, (iv) stop means on the deflector to abut against the base plate and limit movement of the deflector in one direction to raised position.

2. An anti-crossing attachment, as claimed in claim 1, wherein the resilient means is a spring wire having a coiled portion and an arm at each end of the coiled portion, the coiled portion being positioned about the axle, one said arm being connected to the deflector and the other arm being releasably engageable with a catch on the base.

3. An anti-crossing attachment, as claimed in claim 1, wherein a face of said base remote from said upstanding wall portions has thereon a strip of open-pore foam rubber impregnated with adhesive, and a removable protective sheet positioned over said adhesive strip.

4. An anti-crossing attachment, as claimed in claim 1, wherein a face of the stop means which abuts the base plate in said raised position has a layer of vibration absorbent material thereon.

5. An anti-crossing attachment, as claimed in claim 4, wherein said vibration absorbent layer is selected from the group consisting of foam rubber and neoprene.

6. An anti-crossing attachment, as claimed in claim 1, wherein the base plate and the deflector are made of tough, hard plastics material.

7. An anti-crossing attachment, as claimed in claim 6, wherein said plastics material is selected from the group consisting of polypropylenes and polyamides.

8. An anti-crossing attachment, as claimed in claim 6, wherein the base plate is reinforced with fiberglass.

9. An anti-crossing attachment, as claimed in claim 6, wherein the deflector is reinforced with fiberglass.

* * * * *